US006648635B2

(12) United States Patent
Vandrak et al.

(10) Patent No.: US 6,648,635 B2
(45) Date of Patent: Nov. 18, 2003

(54) GAS-FIRED PORTABLE UNVENTED INFRARED HEATER FOR RECREATIONAL AND COMMERCIAL USE

(75) Inventors: Brian S. Vandrak, Highland Heights, OH (US); John D. DuRoss, Jr., Chagrin Falls, OH (US); Allan L. Haire, Garfield Heights, OH (US)

(73) Assignee: Mr. Heater Corporation, Cleveland, OH (US)

( * ) Notice: Subject to any disclaimer, the term of this patent is extended or adjusted under 35 U.S.C. 154(b) by 0 days.

(21) Appl. No.: 10/051,561

(22) Filed: Jan. 18, 2002

(65) Prior Publication Data

US 2002/0058226 A1 May 16, 2002

Related U.S. Application Data

(63) Continuation of application No. 09/731,156, filed on Dec. 6, 2000, now Pat. No. 6,340,298.

(60) Provisional application No. 60/169,062, filed on Dec. 6, 1999.

(51) Int. Cl.[7] ..... F24H 1/06

(52) U.S. Cl. ..... 432/222; 126/91 R; 126/110 B; 126/110 C; 431/328

(58) Field of Search ..... 432/219, 222, 432/223; 126/104 A, 110 A, 110 B, 110 C, 91 R; 431/261, 328, 353, 345

(56) References Cited

U.S. PATENT DOCUMENTS

| | | | |
|---|---|---|---|
| 1,639,780 | A | 8/1927 | Mulholland |
| 3,139,879 | A | 7/1964 | Bauer et al. |
| 3,590,806 | A | 7/1971 | Locke |
| D243,694 | S | 3/1977 | Faulkner |
| 4,340,362 | A | 7/1982 | Chalupsky et al. |
| 4,348,172 | A | 9/1982 | Miller |
| 4,640,680 | A | 2/1987 | Schilling |
| 4,848,313 | A | 7/1989 | Velle |

(List continued on next page.)

FOREIGN PATENT DOCUMENTS

| | | |
|---|---|---|
| GB | 253043 | 6/1926 |

OTHER PUBLICATIONS

*America is Coming Out of the Woods, New Items for '96*, Comfort Glow Vent–Free Heating Products, ©Desa International, Bowling Green, KY 1996.

O'Meara Camping Centers (web page), *Cookers & Heaters*, "Alvima Carasol 3b Heater", data sheets pp. 1–7, Jun. 26, 2002.

Dynamx Incorporated Warehouse Appliance (web page), *Williams Heaters—Vent–Free Home Models*, data sheets pp 1–4, Jun. 26, 2002.

(List continued on next page.)

*Primary Examiner*—Gregory Wilson
(74) *Attorney, Agent, or Firm*—Buckingham, Doolittle & Burroughs, LLP; Louis F. Wagner

(57) ABSTRACT

A portable heater adapted for use in a recreational enclosure or temporary work enclosure includes a housing having an air inlet on the lower front face. A gas supply is partially enclosed by the housing which provides propane to the mouth of a burner venturi located within the housing. Air is drawn through the air inlet and also enters the mouth of the burner venturi. The air and gas are mixed thoroughly as they travel upwardly through the burner venturi. A chimney effect increases fresh air flow velocity into the burner venturi and allows the heater to operate at a reduced fuel gas pressure. Upon exiting the burner venturi, the air/gas mixture is to a plenum and radiant surface where combustion takes place. Any conventional means may be provided to ignite the air/gas mixture in order to cause combustion. The combustion products deflect off a deflector, which is cooled on a rear face by air flow through the housing, which decreases the temperature of the combustion products before exiting an outlet. An oxygen depletion system (ODS) shuts off the portable heater when oxygen levels begin to drop and consequently carbon monoxide levels begin to rise.

38 Claims, 14 Drawing Sheets

U.S. PATENT DOCUMENTS

| | | | |
|---|---|---|---|
| 5,090,899 | A | 2/1992 | Kee |
| 5,239,979 | A | 8/1993 | Maurice et al. |
| 5,645,043 | A | 7/1997 | Long et al. |
| D391,345 | S | 2/1998 | Mandir et al. |
| 5,838,243 | A | 11/1998 | Gallo |
| 5,941,699 | A | 8/1999 | Abele |

OTHER PUBLICATIONS

AGA, American Gas Association, *Fact Sheet*, "Oxygen Depletion Sensing (ODS) Systems", Dec. 1984.

Bullfinch (Gas Equipment) Limited, *The Simba Range Ultra Safe–Low Cost Mobile Cabinet Heaters*, 2 pages, undated.

Moblie Gas Supplies, *Mobile Heaters*, data sheets pp 1–4, Mar. 6, 2002.

Brians of Sheerness, *Valor Fires*, data sheets pp 1–2, Mar. 6, 2002.

Moblie Gas Supplies, *Thurcroft Stove*, data sheets pp 1–2, Mar. 6, 2002.

The Coleman Co., Inc., *3000 BTU Propane Catalytic Heater*, instructions for use pp 1–4, undated.

GAS-FIRED PORTABLE UNVENTED INFRARED HEATER FOR RECREATIONAL AND COMMERCIAL USE

This application is a continuation of application Ser. No. 09/731,156 filed Dec. 6, 2000, U.S. Pat. No. 6,340,298 which claims benefit of Provisional No. 60/169,062 filed Dec. 6, 1999.

BACKGROUND OF THE INVENTION

This invention pertains to an improved portable heaters used in relatively small enclosures. More particularly, the invention relates to a uniquely configured propane source infrared heater for use in enclosures such as small recreational enclosures, temporary work enclosures, or vehicles. Although the invention was designed for indoor areas, it will be appreciated that it has broader applications and may be advantageously employed in a wide variety of environments without departing from the scope of the invention.

Gas-fired portable heaters are well known in the art and are used in multiple environments. The heater typically includes a housing having a chamber. The housing has an inlet for receiving air into the chamber. Gas is introduced into the chamber to be mixed with the air in order to complete combustion and provide an infrared heating surface. A plenum directs the heat toward a mesh screen and evenly distributes it over the surface thereof. The overall goal in designing such a unit is to achieve a radiant surface that provides even, stable heating over the entire surface.

The use of such heaters is strictly regulated for outdoor only use due to the emission of carbon monoxide. Prior designs in existing portable units are subject to a wide variety of problems. Most importantly, the prior designs are not safe or certified to operate in small recreational enclosures such as tents, truck-caps, fishing huts, trailers, vans, etc. There are a few reasons why the devices found in the prior art are not adequate to perform in such environments. First, the portable heaters that exist today operate at a high pressure generally on the order of 12 psi. Specifically, the pressure from the propane tank through a regulator is necessarily high in order to achieve adequate gas and air flow. In addition to requiring high pressure, previous designs do not have the ability to pass strict combustion requirements at a high and low firing condition and at a reduced pressure. For example, a new standard developed for this product (CSA International 4.98 US) states that "the appliance shall not produce carbon monoxide in excess of 0.010 (100 ppm) percent in a room with no air changes occurring during combustion of the amount of gas necessary to reduce the oxygen content of the room to 18 percent by volume." In addition, they do not possess an oxygen depletion system (ODS)(Capreci/Part No. 21500). These shortcomings have prevented the portable heaters found in the prior art from adequately performing in small recreational and temporary work enclosures.

Therefore, a need exists to provide a portable infrared heater capable of performing safely in small recreational enclosures and temporary work enclosures.

SUMMARY OF THE INVENTION

This invention contemplates a new and improved burner assembly that is capable of performing safely in small recreational facilities such as tents, truck-caps, vans, fishing huts, trailers, etc.

According to the present invention, a portable heater includes an outer housing having a first or front face, a second or rear face, and two sides interconnecting the front and rear faces. An air inlet is located on the front face of the housing, preferably along a lower portion thereof. A gas supply or tank is partially enclosed and supported by the outer housing. A burner venturi, having a cylindrical body extending upwardly at a slight angle, is disposed within the housing. The burner venturi also has a mouth operatively associated with a bottom end of the cylindrical body. Gas is released from the gas supply into the mouth of the burner venturi. At the same time, air is drawn into the mouth of the burner venturi from the air inlet. The air and gas mix thoroughly as they travel upwardly through the burner venturi.

Upon exiting the burner venturi, a baffle directs the air/gas mixture into a plenum to further mix, enter a rear face of a radiant surface, and then ignited on a top surface where combustion occurs. Any conventional means for initially sparking or igniting the air/gas mixture at the burner surface can be used. The burner plenum is heated to an elevated temperature and the radiant surface emits heat to the ambient environment. Combustion products are directed off a deflector shield which reduces the temperature of the products before exiting an outlet at an upper portion of the housing.

The air inlet of the present invention is advantageously designed to provide air flow along the hot burner plenum resulting in an increased velocity of air flow to the burner venturi. As the burner venturi is heated, the thermal properties result in the air/gas mixture passing upwardly through the angled burner venturi creating a chimney type effect. The chimney effect created by the present invention increases the air flow velocity into the burner venturi. In addition, the device reduces pressure from the gas supply and has the ability to satisfy combustion requirements at low fire condition.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
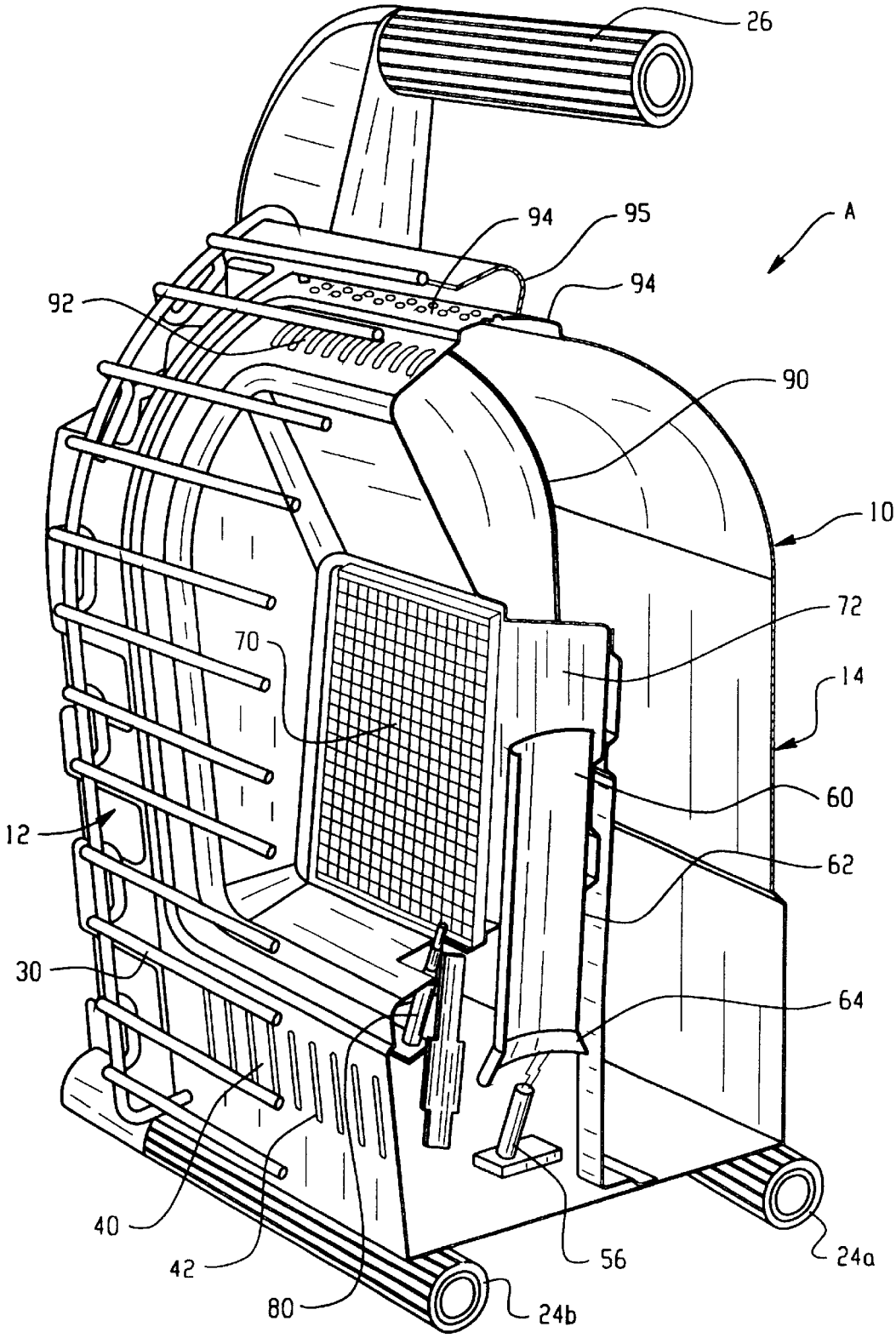
FIG. 1 is a perspective cross-sectional view of a heater assembly in accordance with the teachings of the present invention.

Referring now to the drawings wherein the showings are for purposes of illustrating the preferred embodiment of the invention only, and not for purposes of limiting same, the FIGURES show a portable heating device A adapted for use in small enclosed environments. Although the present invention is designed for use in recreational enclosures and temporary work enclosures, it will be appreciated that other uses are contemplated.

The portable heater A includes a housing 10 having a front face 12, a rear face 14, and two sides 16, 18. The housing 10 is preferably manufactured to have smooth contours to prevent snagging or catching of things such as clothing, fabric, etc. A stepped recess or external cavity is formed in an upper front corner region of the left side 16 of the housing 10 for supporting a control knob or temperature controller 20. The recess provides protection against inadvertent contact and accidental changing of the temperature. The temperature controller 20 preferably has four positions: off, pilot, low, and high (not shown).

Another recess is disposed on the upper back corner of the left side 16 of the housing 10. This recess supports an ignitor button 22 for activating the heater A. This recess also protects against inadvertent contact with the ignitor button 22.

The heater A is supported by two elongated legs 24*a*, 24*b* laterally disposed along the outboard edges of the rear face 14 and front face 12 respectively. The legs 24*a*, 24*b* are preferably grooved providing a friction surface to contact the supporting surface and preferably extend over the entire width of the housing to provide a wide "footprint" and stable support area for the heater. In another embodiment (not shown), additional legs extending front to rear are provided beneath legs 24*a*,24*b* to increase air flow beneath the heater. A handle 26 is recessed from and extends from the top of the heater at an angle directed away (approximately 15°) from the front face 12. The offset allows the handle to remain cool for handling by a user while the angled orientation of the handle 26 protects the user's hand from heat exiting the top of the heater while the user transports the heater. The handle 26 is also grooved providing an enhanced gripping surface for the user.

A shield or metal grid 30 is attached to the front face 12 of the heater to provide protection to the heater components. In addition, the shield prevents accidental contact with the hot portions of the heater front face 12. The shield is preferably made from elongated wire metal strips and peripheral pieces are received in openings 32 in the housing to secure the shield to the heater. In addition, only one screw (not shown) need be removed for access to the interior components enabling easy servicing or replacement of selected components of the heater. Two keyhole openings or recesses 34*a*, 34*b* are located on the upper portion of the back face 14 of the heater allowing the user to hang the heater in an elevated position.

An opening or air inlet 40 is disposed on a lower portion of the front face 12 of the heater for receiving and filtering air drawn into the housing. The air inlet 40 is preferably formed from a series of elongated slits 42 equispaced across the housing beneath the shield. However, any opening that adequately provides air inflow is within the scope of the present invention.

Figure 5:
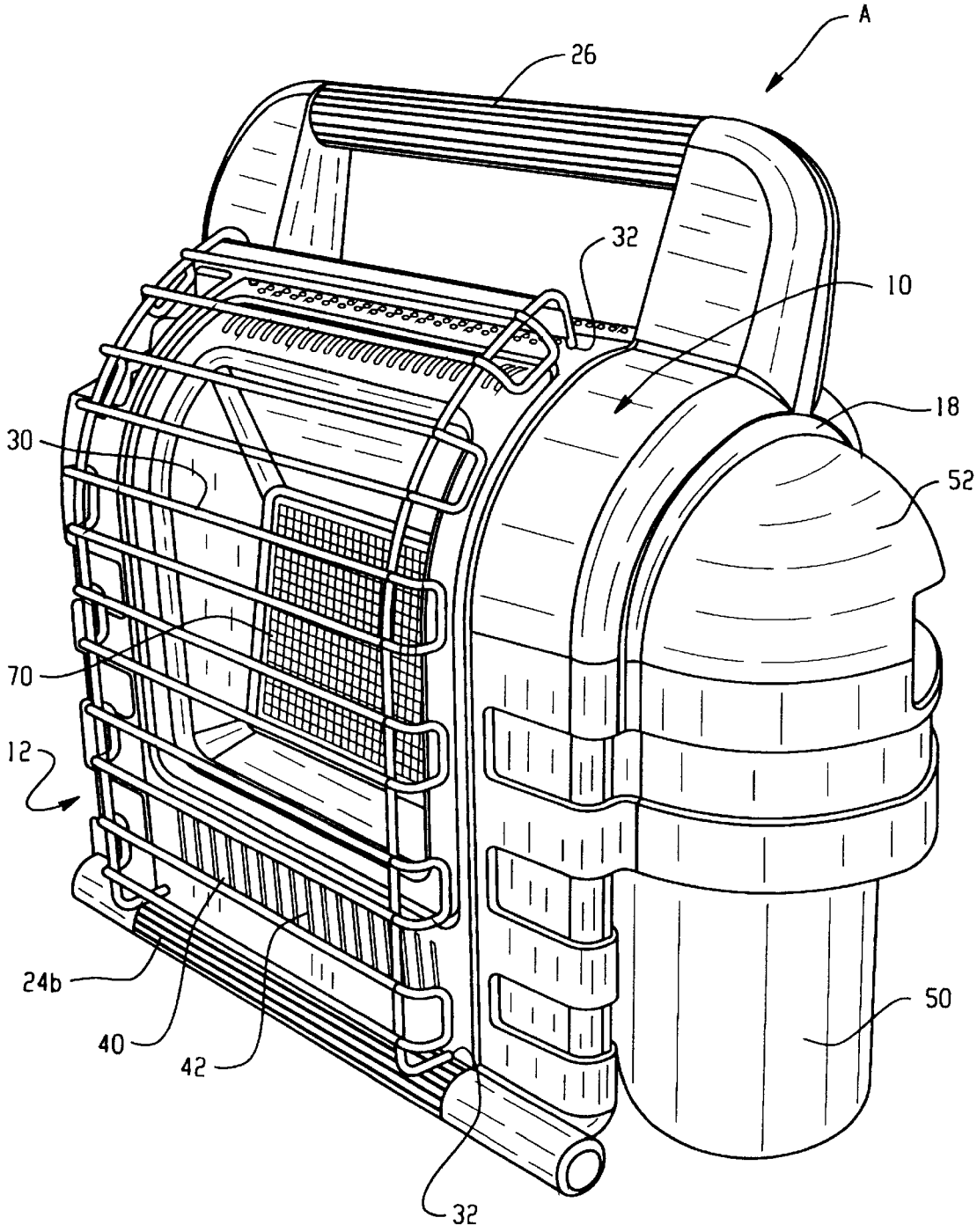
FIG. 5 is a perspective view of the heater taken generally from the front and right-hand side.
Figure 6:
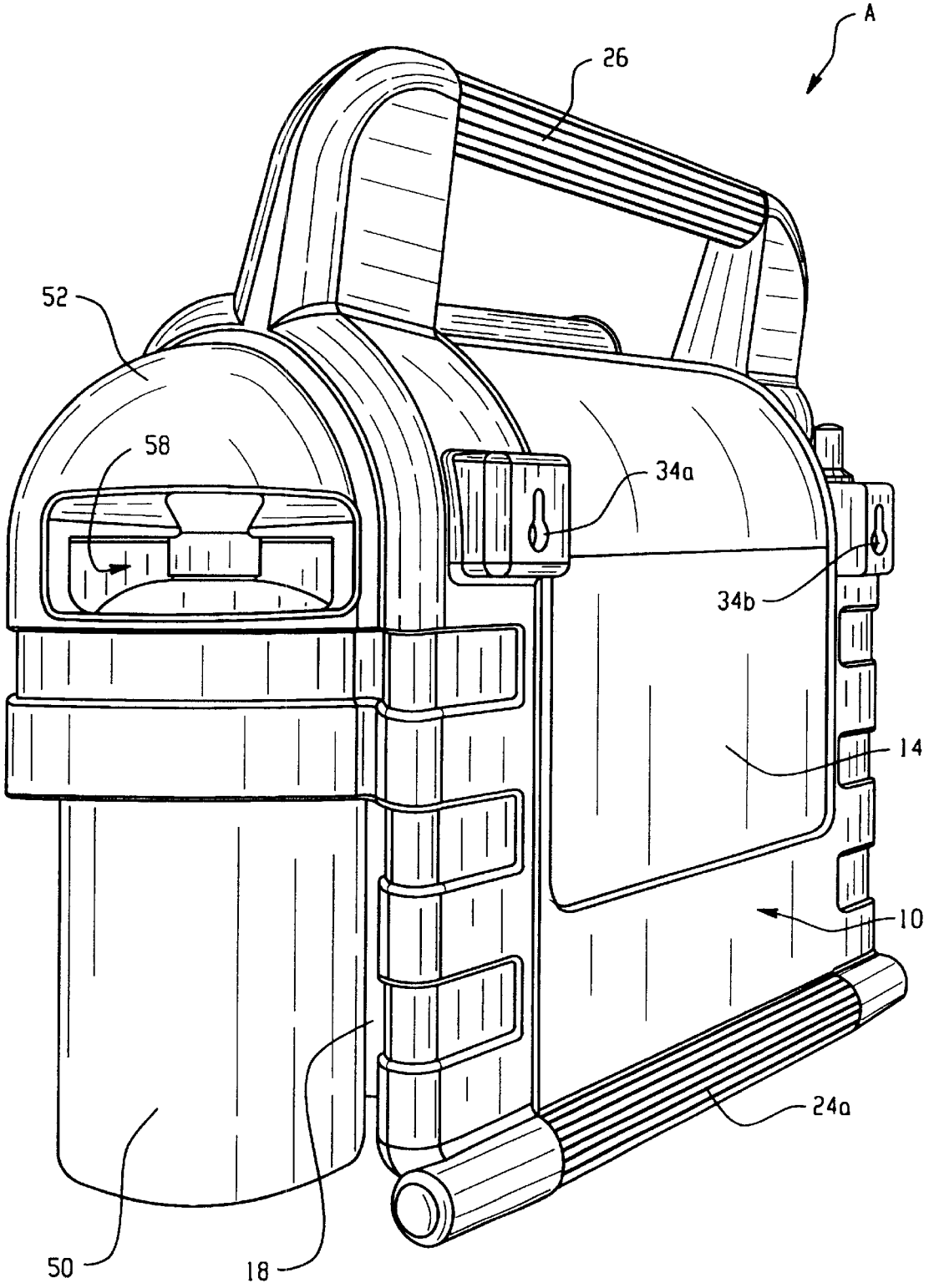
FIG. 6 is a perspective view of the heater taken generally from the rear and right-hand side.
Figure 7:
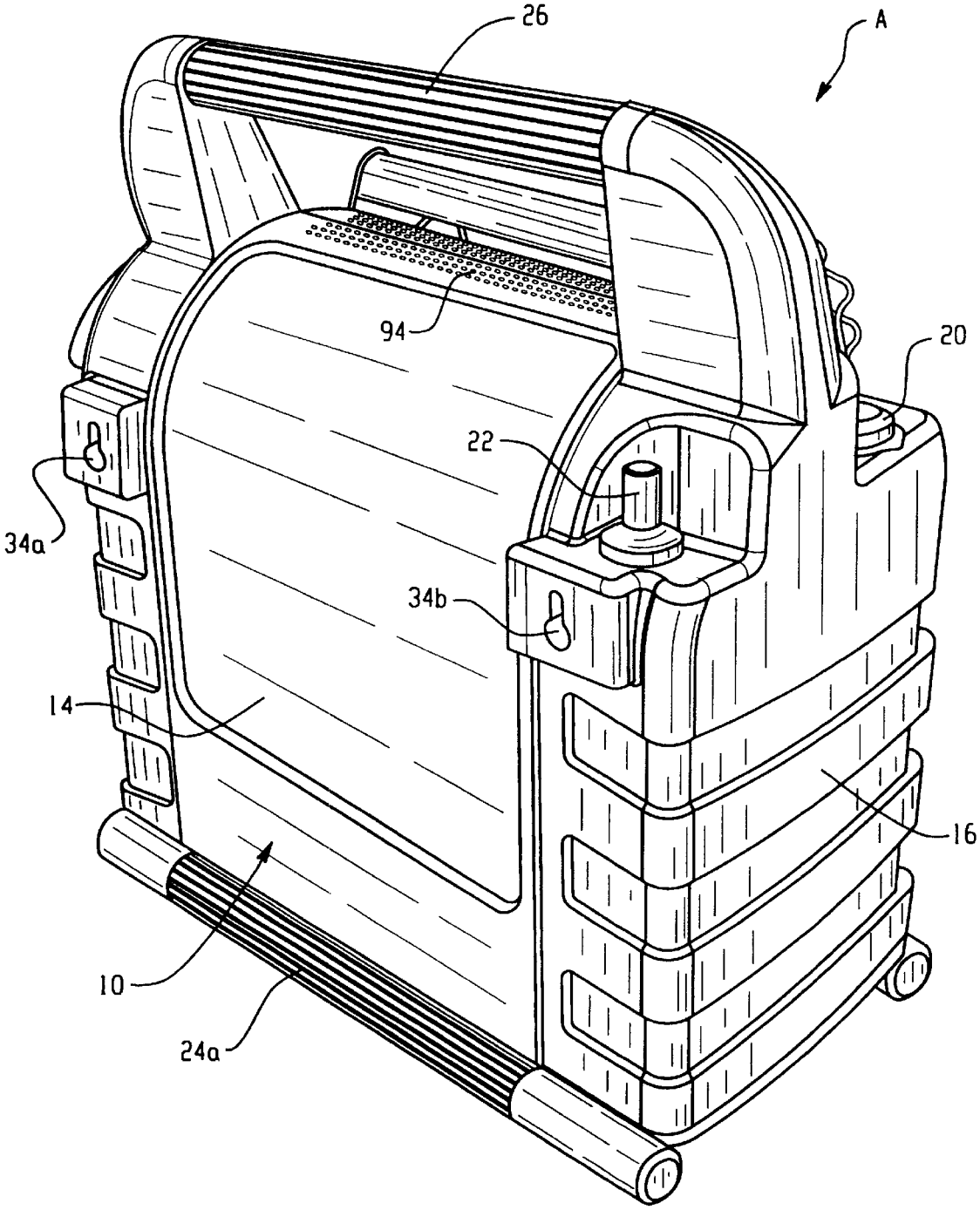
FIG. 7 is a perspective view of the heater taken generally from the rear and left-hand side.
Figure 8:
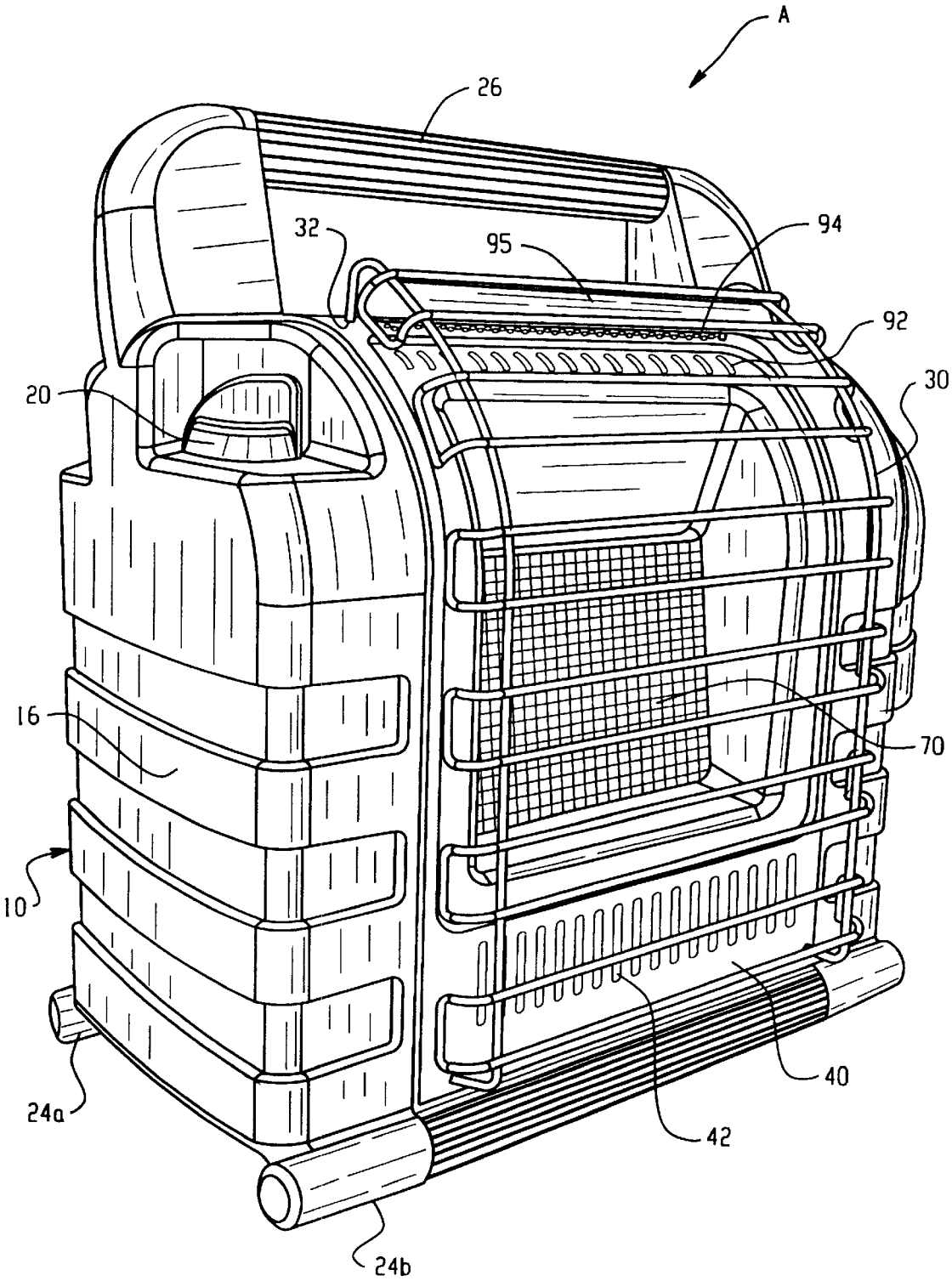
FIG. 8 is a perspective elevational view of the heater in accordance with the present invention.
Figure 9:
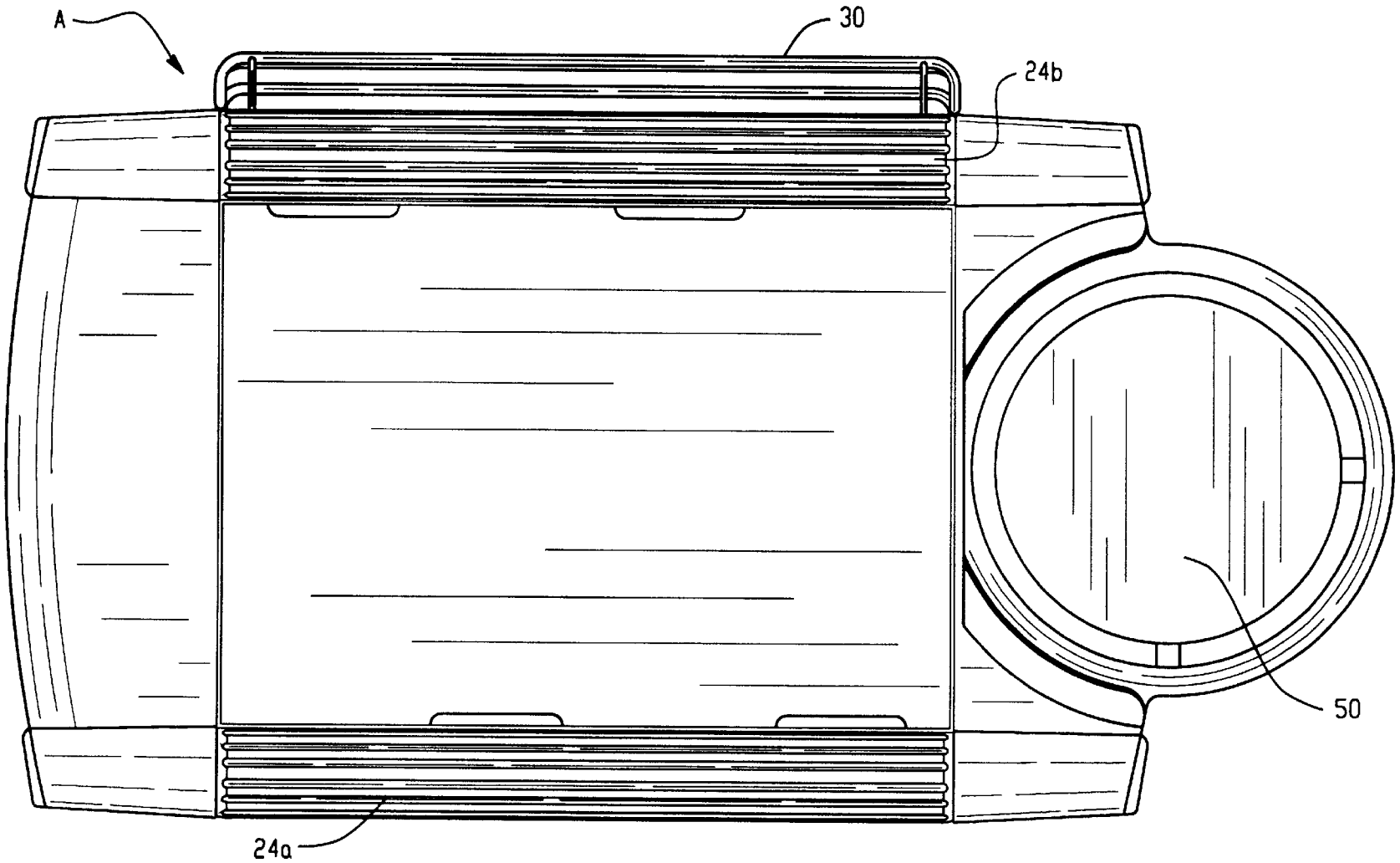
FIG. 9 is a bottom view of the portable heater.
Figure 10:
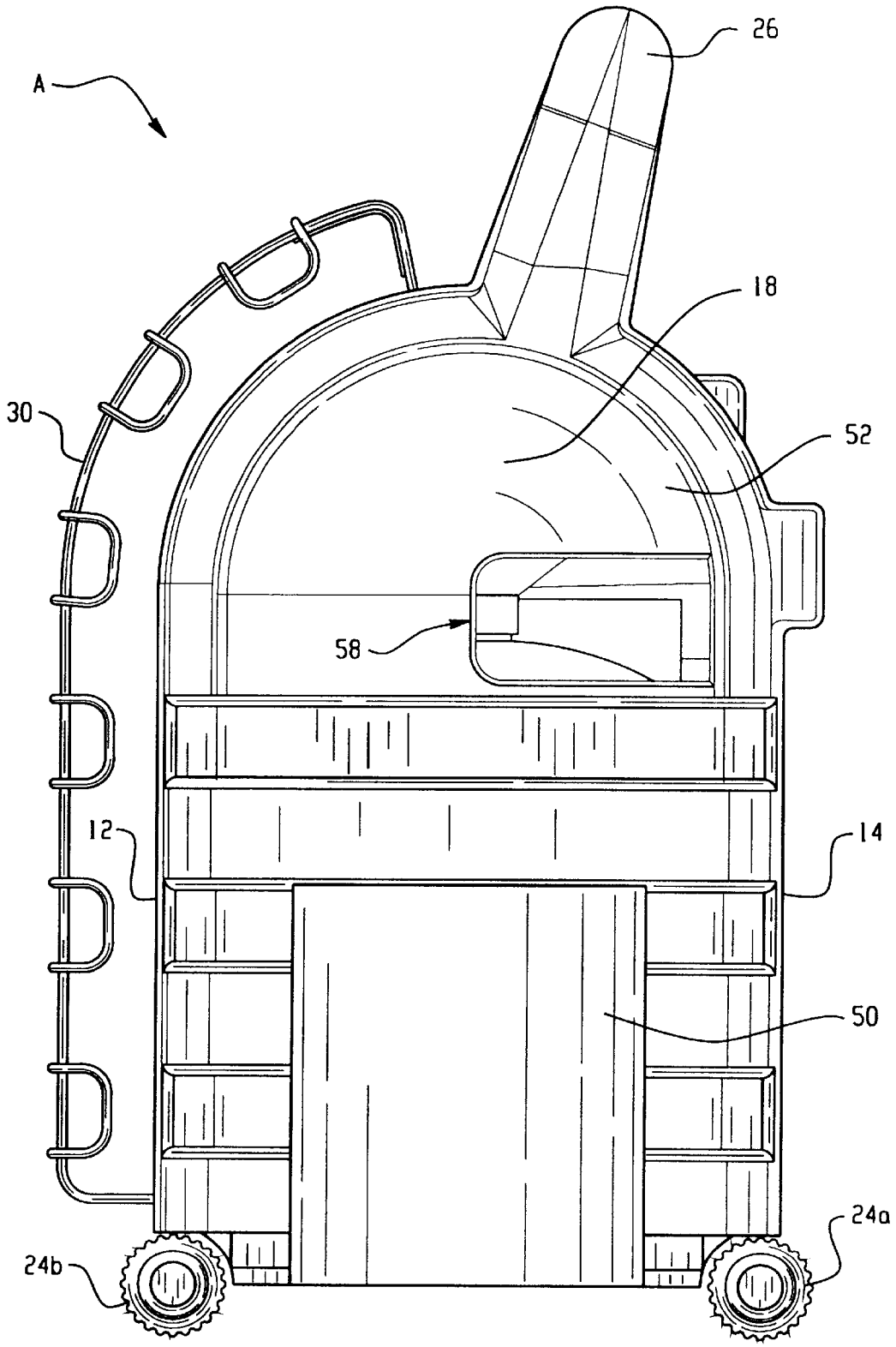
FIG. 10 is a side elevational view of the portable heater.
Figure 11:
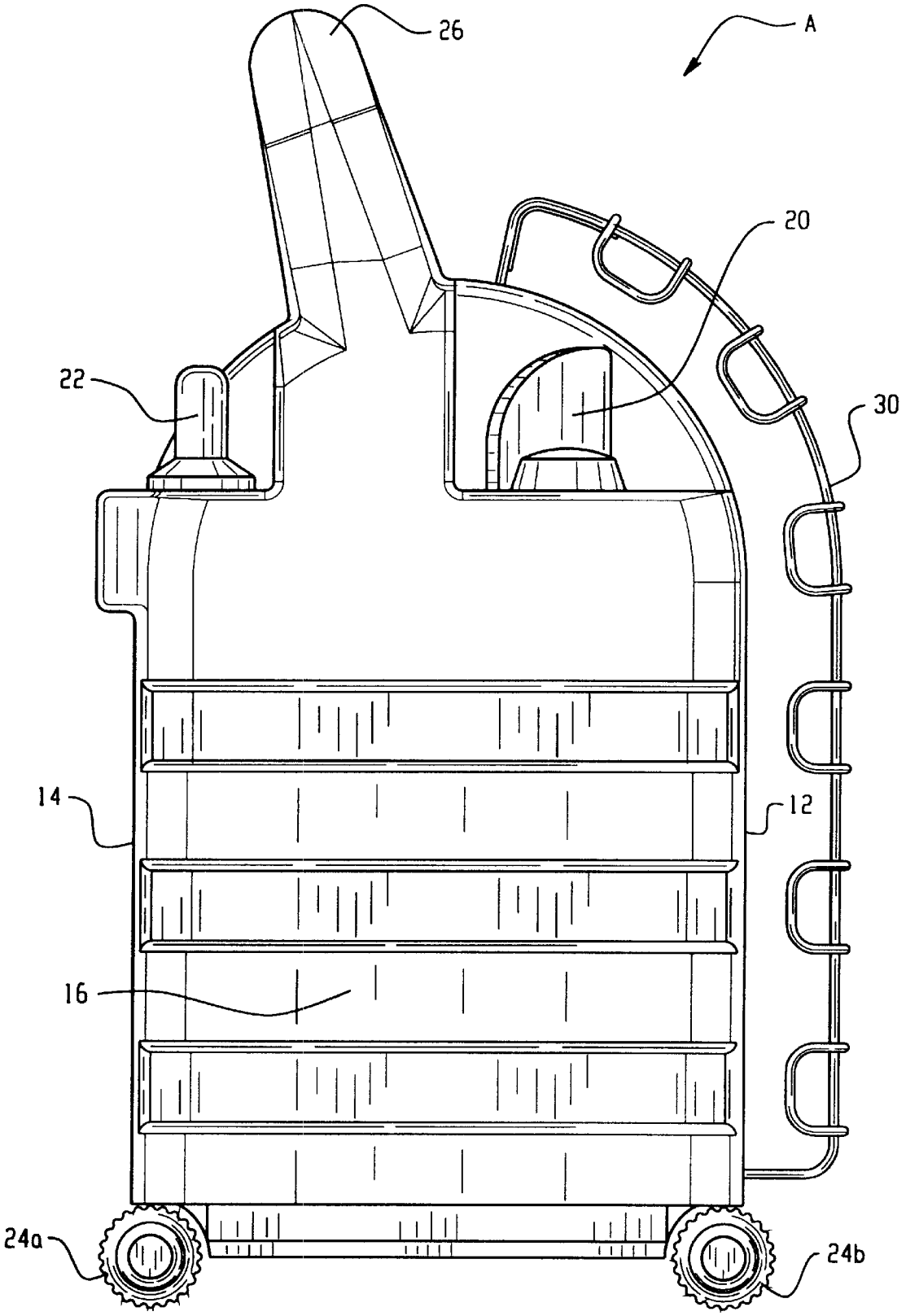
FIG. 11 is a side elevational view of the portable heater.
Figure 12:
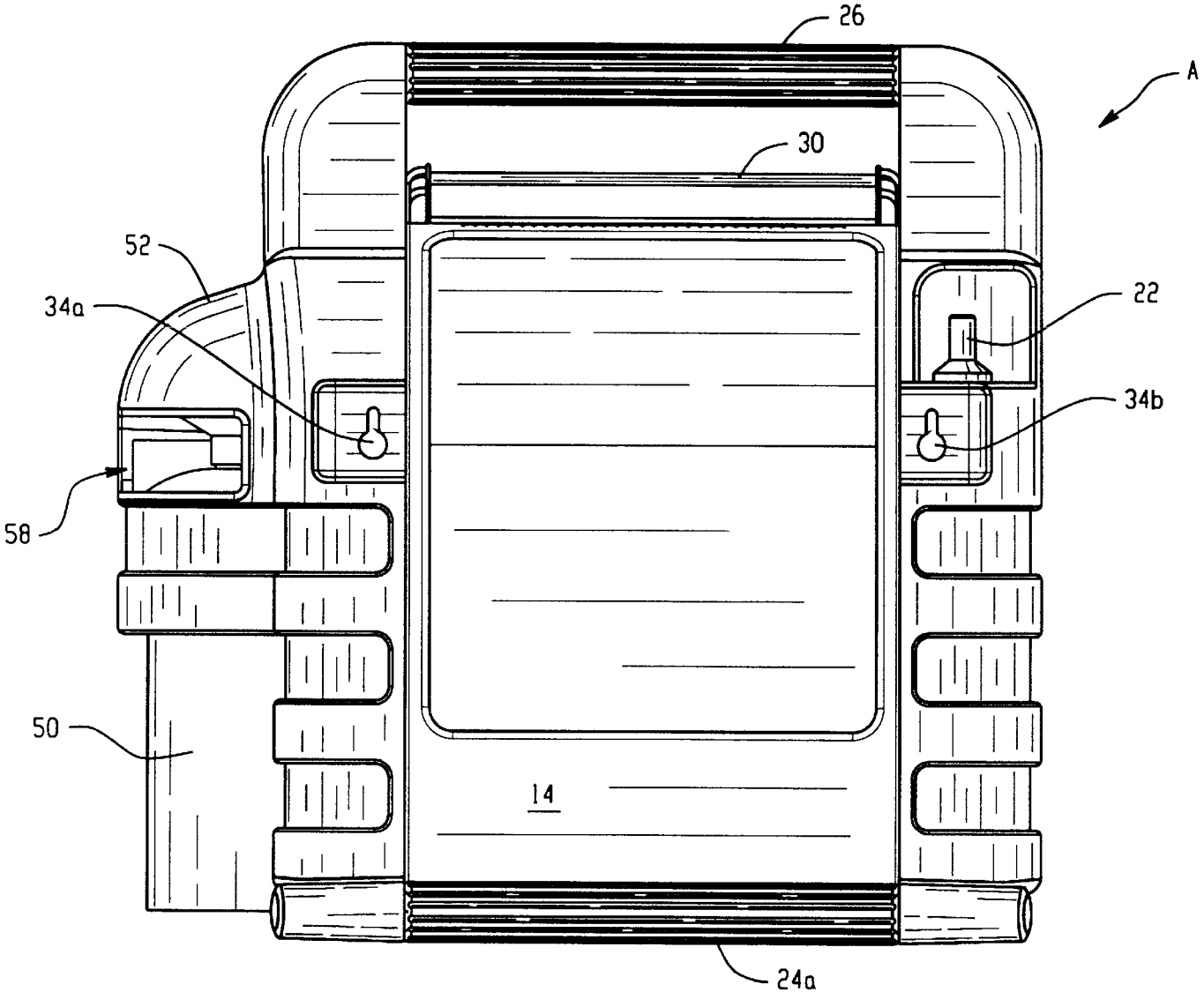
FIG. 12 is a rear elevational view of the portable heater.
Figure 13:
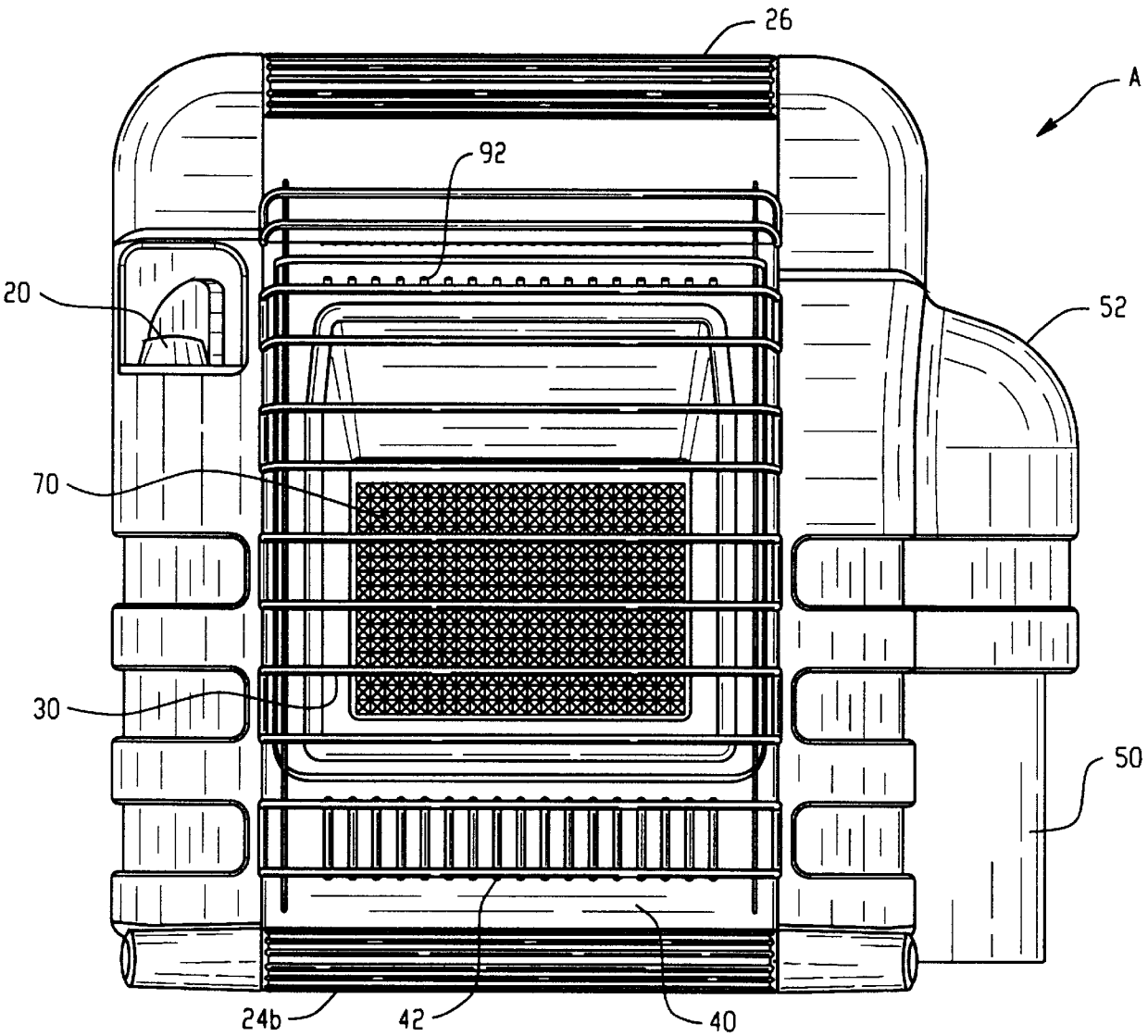
FIG. 13 is a front elevational view of the portable heater.
Figure 14:
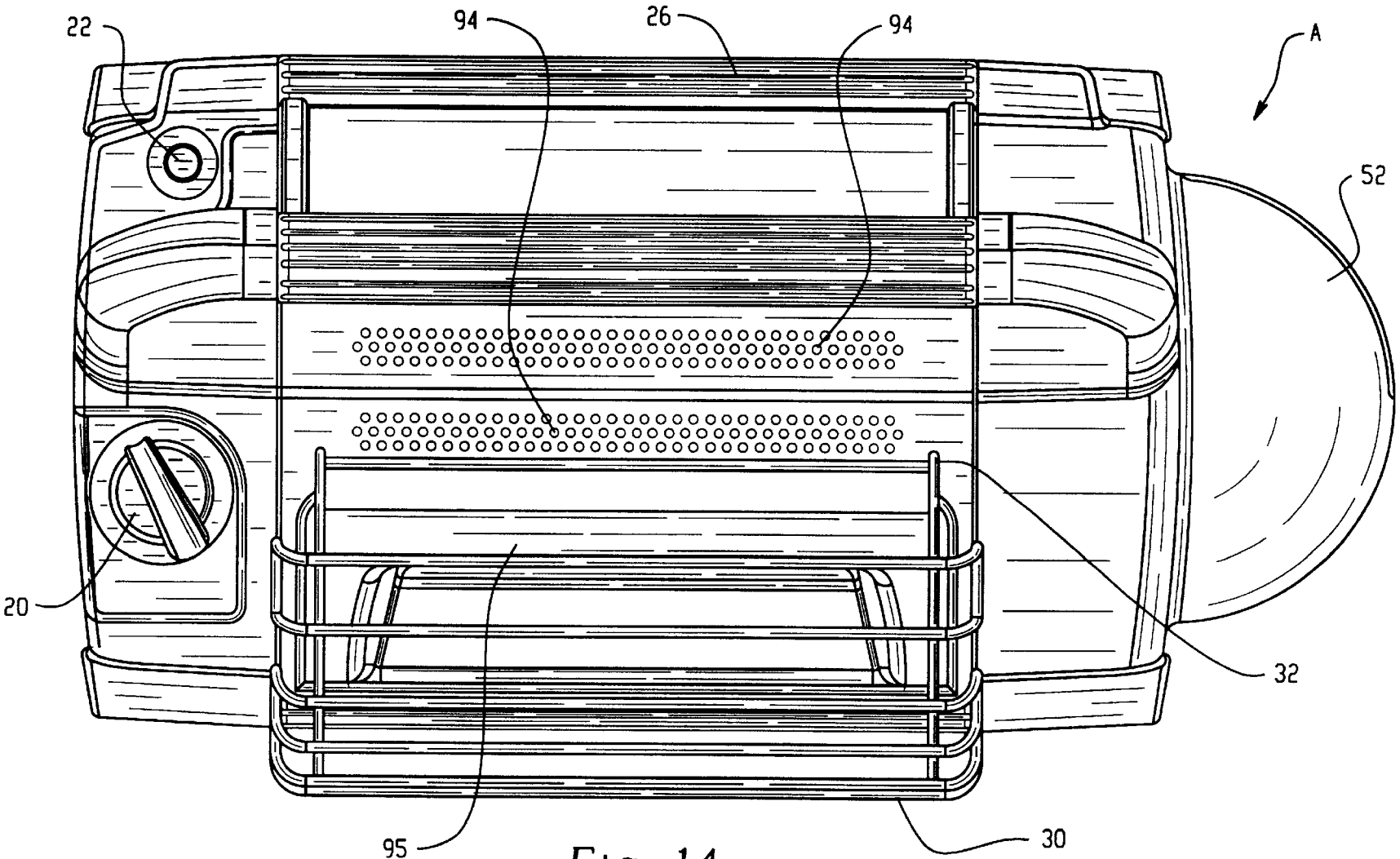
FIG. 14 is a top view of the portable heater in accordance with the present invention.

An LP gas supply tank 50 is secured to and partially enclosed by the housing 10 (See FIGS. 5 and 6). The LP gas supply 50 is preferably a removable canister or propane tank that can be replaced by a new tank or removed, refilled, and re-installed in the housing. A conical dome 52 protrudes from the side 18 of the housing 10 and partially encloses the gas supply tank 50. The dome acts as a protective shroud to cover the interconnection of the tank with the housing. For example, a one pound propane cylinder may be connected to the housing to provide approximately six hours of continuous operation on the low setting. Alternatively, the heater can be supplied, for example, by a conventional twenty pound propane tank having an extended length hose assembly so that the tank can be located away from the heated region. For instance, the propane tank can be positioned outside a tent, cabin, fishing shanty garage, etc. while the heater is located within the structure and the heater provide on the order of one hundred and ten hours of heat with the larger gas supply tank.

The gas supply 50 is connected to a regulator which connects to a valve and orifice 56 (See FIG. 1) which is selectively adjustable between open and closed positions, access being provided to the regulator through window opening 58 for remote LP gas supply hose tightening and leak checking (see FIG. 6).

Figure 2:
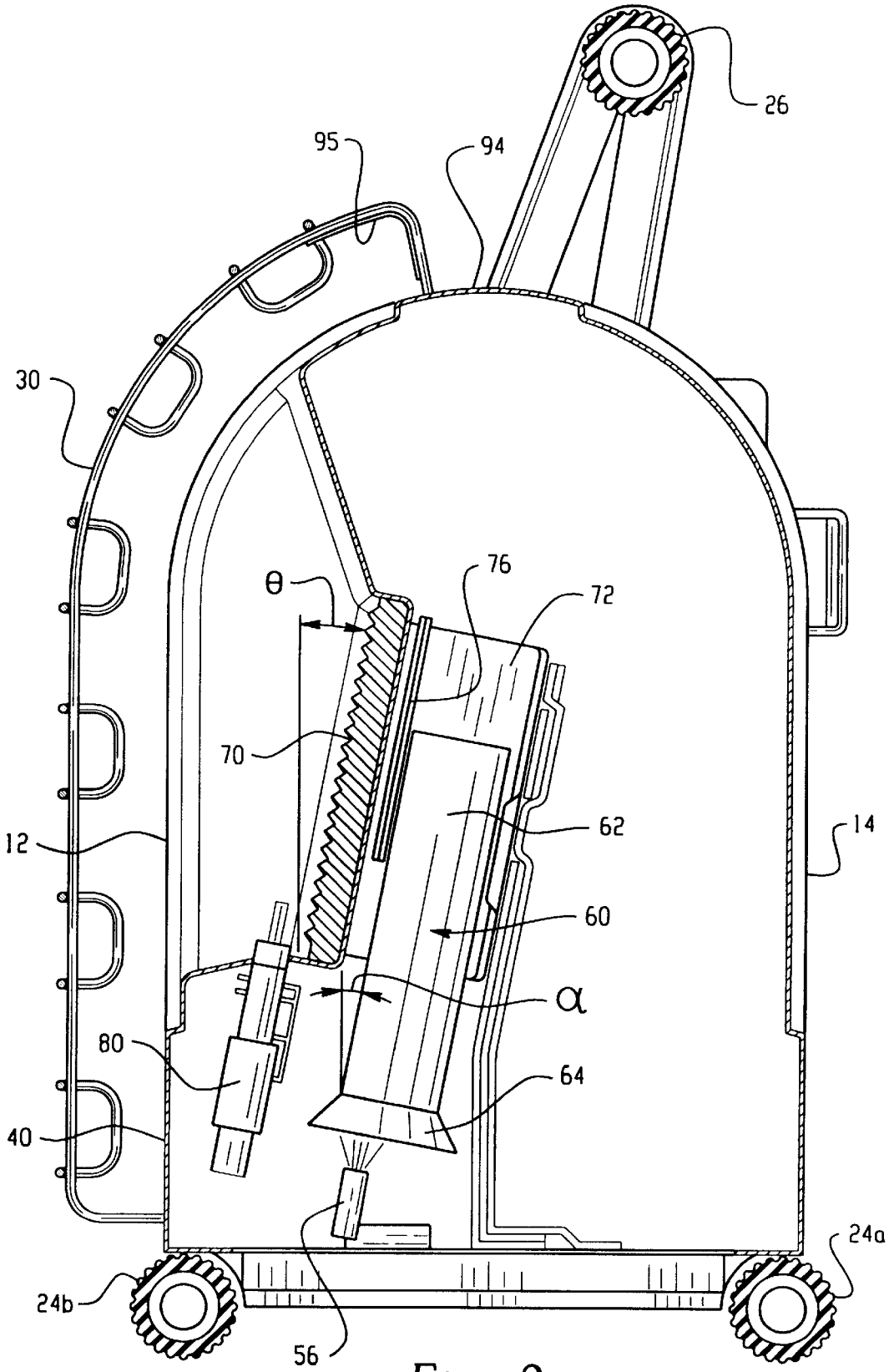
FIG. 2 is a longitudinal cross-sectional view of the heater assembly in accordance with the present invention.

Referring again to FIGS. 1 and 2, a burner venturi 60 is enclosed within the housing 10 and operates to mix oxygen and propane for combustion. The burner venturi 60 has a hollow generally cylindrical body 62 and a tapered mouth 64 having a wider diameter than the body 62. The burner venturi is disposed at an angle $\alpha$ relative to the longitudinal axis of the heater A. The mouth 64 of the burner venturi is positioned on approximately the same axial plane as the air inlet 40 and the cylindrical body 62 extends upwardly from the mouth 64. The orifice 56 which is attached to the gas supply 50 is located directly beneath the mouth 64 of the burner venturi 60.

Also located within the housing A is a generally planar radiant surface 70 disposed at an angle $\theta$ relative to the longitudinal axis of the heater. A rear face of the radiant surface is in communication with a cavity or plenum chamber 72. The burner plenum receives the air/gas mixture from the venturi and distributes the mixture over and through the rear face of the radiant surface. Thus, in operation, the orifice 56, attached to the gas supply, is opened releasing a fuel gas such as propane into the mouth 64 of the burner venturi 60. Associated with the orifice is a regulator that reduces the delivery pressure of the fuel gas from the tank (rated up to 150 psi) to eleven inches of water column in one stage. Thus, this portable heater operates at a significantly lower pressure than existing commercially available units. The stream of gas exiting the orifice 56 creates a vacuum effect drawing air from the air inlet 40 into the mouth 64 of the burner venturi. Propane and air are thoroughly mixed in the burner venturi 60 and plenum 72 in order to achieve complete combustion and produce a clean burning infrared heating surface. The mixture of oxygen and propane travels upward through the cylindrical body 62 of the burner venturi 60 until reaching the plenum chamber 72. To prevent the mixture of propane and oxygen from immediately exiting the plenum chamber 72, a solid baffle 76 is provided which forces the air/gas mixture downward into communication with the rear face of the radiant surface.

The radiant surface may be a burner tile or a multi-ply screens (not shown) that define a plurality of small openings which permit combustion of the air/gas mixture as it passes therethrough. A means is provided for initially sparking or igniting the mixture at the radiant surface. In the present invention a container 80 houses the pilot 82 and the ignitor 84 (see FIG. 3) which provides the initial sparking. It will be appreciated that any conventional means for initially sparking or igniting the mixture can be utilized. Combustion of the air/gas mixture is maintained and reaches elevated temperatures of approximately 1200° F. The heater shown in the drawings is rated at a minimum 4000 BTUs and a maximum 9000 BTUs at eleven inches water column pressure. Other ratings below 12,000 BTUs are also potential alternatives.

A reflector 90 extends outwardly from the top of the burner plenum 72 at an angle directed toward the top portion of the front face 12 of the housing 10. The natural convective upward path of the combustion products leads the combustion products into contact with the reflector 90. The reflector 90, in addition to directing the radiant energy output from the heater toward the front surface of the housing, also acts as a deflector and reduces the temperature of the combustion products exiting the heater which greatly reduces the chance for ignition of a combustible material if it comes into contact with the heater A. An outlet 92 is disposed near the top of the housing 10 allowing warm air to mix with combustion products and exit the device after contacting the reflector 90. In addition, a deflector 95 is disposed on the top of front face 12 which reduces the temperature of the combustion products exiting the heater which greatly reduces the chance for ignition of a combustible material if it comes into contact with the heater A.

In addition, there is an outlet or grate 94 disposed rearwardly of outlet 92 that communicates with the interior of the housing. It provides a continuous flow path for air (that does not enter the venturi) to flow from the inlet 40 around the rear of the plenum chamber and exit the housing rearwardly of the deflector. This enhances the chimney effect as described above since a large amount of ambient air is drawn into the housing, a portion used for combustion purposes and the remainder convects upwardly along the rear of the plenum and the deflector to exit via the openings 94. The air inlet 40 of the present invention is designed to encourage air flow along the back of the hot burner plenum 72, advantageously resulting in an increased velocity of air flow to the burner venturi, as well as cooling the rear housing 10. As the burner venturi 60 is heated, the thermal convection properties urge the air/gas mixture through the upwardly angled burner venturi 60 creating a chimney type effect. The chimney effect created by the present invention increases the fresh air flow velocity into the burner venturi, enabling the pressure from the gas supply 50 to be reduced, yet burn efficiently on high or low settings.

Figure 3:
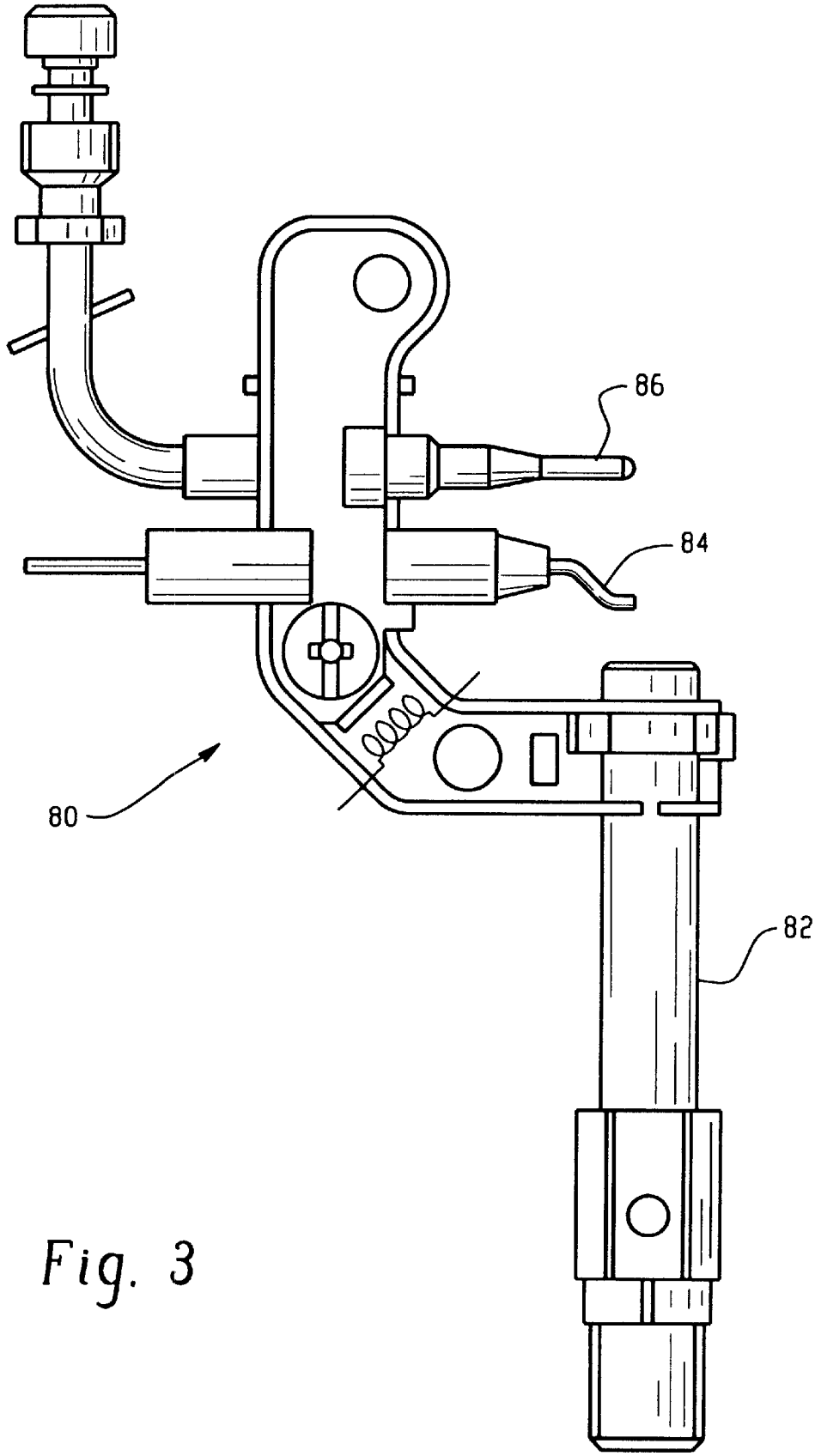
FIG. 3 is an enlarged elevational view of a thermocouple, spark ignitor, and pilot tube assembly used in the preferred embodiment of the present invention.
Figure 4:
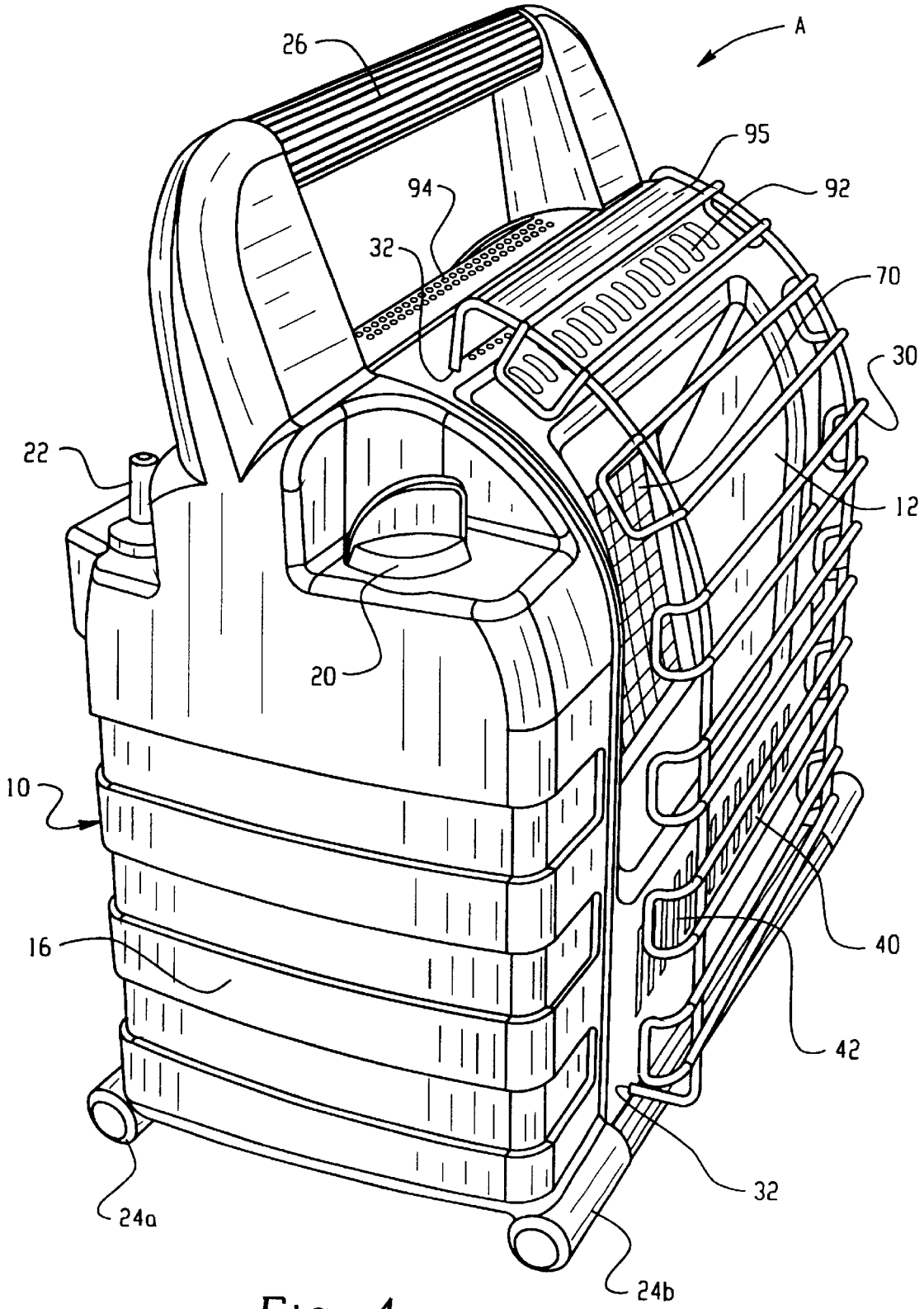
FIG. 4 is a perspective view of the heater taken generally from the front and left-hand side.

In addition to housing the pilot 82 and the ignitor 84, the container 80 preferably houses an oxygen depletion system (See FIG. 3). The oxygen depletion system (ODS) provides an automatic shutoff mechanism when decreased oxygen levels and resulting increased carbon monoxide concentrations are detected. For example, the heater of the present design is intended to automatically shut off at 100 PPM of carbon monoxide at 16% oxygen levels (21% free normal air). A thermocouple 86 monitors changes in temperature of the pilot flame which indicates changes in oxygen and carbon monoxide levels. Previous designs found in the prior art use a thermocouple/plunger type safety shut-off arrangement, which is not deemed to be as sophisticated or precise as the ODS of the present invention. The addition of an ODS to portable unvented heaters is an improvement in the art and the first of its kind. A more detailed discussion of the ODS can be found in a variety of resources.

The present invention significantly reduces the pressure from the propane tank in one stage. The pilot and main burner must operate at 11" water column (W.C.) per the new standard. This is the first portable device for indoor use that the applicant is aware of that conforms to this standard. The portable heaters that exist today all operate at high pressures (on the order of 12 psi) and do not incorporate an ODS. In addition, the present device has the ability to pass combustion requirements at a low fire condition.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents thereof.

Having thus described the invention, it is now claimed:

1. A portable gas-fired infrared heater for recreational and commercial use in relatively small enclosures, the heater comprising:

a housing enclosing a burner assembly including a gas valve adapted to receive fuel from an associated fuel supply and communicating with an orifice, the orifice being located to direct fuel to a venturi for mixing with air which, in turn, communicates with a rear face of a radiant surface where combustion occurs, the housing further including an air inlet for communicating air to the venturi;

a shroud extending from the housing dimensioned to at least partially enclose an associated fuel supply tank; and an oxygen depletion system associated with the burner assembly for automatically shutting off the heater at a predetermined oxygen content.

2. The portable heater of claim 1 further comprising a handle spaced from the radiant surface.

3. The portable heater of claim 2 wherein the radiant surface is recessed in the housing and disposed at an angle.

4. The portable heater of claim 3 wherein the handle is mounted at an angle of approximately 15° from vertical.

5. The portable heater of claim 1 further comprising legs that elevate the housing relative to an associated support surface.

6. The portable heater of claim 1 further comprising at least one recess in the housing for hanging the heater.

7. The portable heater of claim 6 wherein the recess is a key-shaped opening.

8. The portable heater of claim 6 wherein the recess is located on a surface of the housing spaced from the radiant surface.

9. The portable heater of claim 1 further comprising an igniter secured to the housing for initiating combustion at the radiant surface.

10. The portable heater of claim 1 wherein the shroud is dimensioned to enclose an upper portion of an associated one pound propane fuel tank.

11. The portable heater of claim 1 further comprising a controller for selectively switching operation of the portable heater among discrete off, pilot, low, and high positions.

12. The portable heater of claim 11 wherein the controller includes a control knob disposed in a housing recess for protecting against inadvertent contact.

13. The portable heater of claim 1 further comprising an extended length hose assembly for connecting the heater to an associated remote fuel source.

14. The portable heater of claim 1 further comprising a regulator for reducing pressure from an associated fuel source.

15. The portable heater of claim 14 wherein the regulator limits the pressure of an associated fuel source to approximately eleven inches water column.

16. The portable heater of claim 1 further comprising a thermocouple that monitors changes in temperature of a pilot flame associated with the radiant surface.

17. The portable heater of claim 1 further comprising a shield secured to the housing in overlapping relation to the radiant surface.

18. A portable radiant heater comprising:

a housing having a handle for transporting the heater;

an air inlet in the housing;

a burner assembly mounted in the housing including a fuel valve adapted to operatively communicate with an associated fuel source and the air inlet, and a radiant surface having a rear face communicating with a plenum chamber and wherein the radiant surface is recessed in the housing and disposed at an angle; and an oxygen depletion system operatively associated with the burner assembly for automatically shutting off the fuel valve in response to a preselected reduced oxygen content.

19. The portable heater of claim 18 wherein the plenum chamber is adjacent to the radiant surface for distributing an associated air/fuel mixture over the rear face of the radiant surface.

20. The portable heater of claim 18 further comprising a regulator for limiting the pressure of the associated fuel source to approximately eleven inches water column.

21. The portable heater of claim 18 further comprising a control knob for selecting various modes of operation of the heater, the control knob located in a recess of the housing for limiting inadvertent contact.

22. The portable heater of claim 18 wherein the heater includes a controller for providing approximately 4000 BTUs/hour in a first operative state and approximately 9000 BTUs/hour in a second operative state.

23. The portable heater of claim 18 further comprising an elongated hose assembly for interconnecting the heater to an associated remotely located fuel source.

24. The portable heater of claim 18 wherein the housing includes a cavity dimensioned for receiving an associated fuel tank therein.

25. The portable heater of claim 18 further comprising a venturi interposed between the fuel valve and the radiant surface for mixing the associated fuel with air.

26. The portable heater of claim 18 wherein the handle is mounted at an angle of approximately 15° C. from vertical.

27. A portable radiant heater comprising:

a housing having a handle for transporting the heater;

an air inlet in the housing;

a burner assembly mounted in the housing including a fuel valve adapted to operatively communicate with an associated fuel source and the air inlet, and a radiant surface having a rear face communicating with a plenum chamber and wherein the radiant surface is recessed in the housing and disposed at an angle; and an automatic shutoff mechanism operatively associated with the burner assembly for shutting off the fuel valve in response to a preselected reduced oxygen content.

28. The portable radiant heater of claim 27 wherein the automatic shutoff mechanism includes a thermocouple that monitors changes in a temperature of a flame of the burner assembly indicative of changes in oxygen and carbon monoxide levels.

29. The portage radiant heater of claim 27 wherein the automatic shutoff mechanism shuts off at approximately 100 ppm of carbon monoxide at approximately 16% oxygen levels.

30. The portable radiant heater of claim 27 further comprising a shroud extending from the housing dimensioned to at least partially enclose an associated fuel supply tank.

31. The portable heater of claim 27 wherein the shroud is dimensioned to enclose an upper portion of an associated one pound propane fuel tank.

32. The portable heater of claim 27 further comprising a controller for selectively switching operation of the portable heater among discrete off, pilot, low, and high positions.

33. The portable heater of claim 32 wherein the controller includes a control knob disposed in a housing recess for protecting against inadvertent contact.

34. The portable heater of claim 27 further comprising an extended length hose assembly for connecting the heater to an associated remote fuel source.

35. The portable heater of claim 27 further comprising a regulator for reducing pressure from an associated fuel source.

36. The portable heater of claim 35 wherein the regulator limits the pressure of an associated fuel source to approximately eleven inches water column.

37. The portable heater of claim 27 further comprising a shield secured to the housing in overlapping relation to the radiant surface.

38. The portable heater of claim 27 wherein the handle is mounted at an angle of approximately 15° C. from vertical.

* * * * *